US006557864B1

(12) United States Patent
Lenoir

(10) Patent No.: US 6,557,864 B1
(45) Date of Patent: May 6, 2003

(54) IN-LINE ROLLER SKATE WITH DETACHABLE BOOT

(75) Inventor: David Lenoir, Morges (CH)

(73) Assignee: Lange International S.A., Fribourg (CH)

( * ) Notice: Subject to any disclaimer, the term of this patent is extended or adjusted under 35 U.S.C. 154(b) by 0 days.

(21) Appl. No.: 09/218,843

(22) Filed: Dec. 22, 1998

(30) Foreign Application Priority Data

Dec. 24, 1997 (CH) ..... 2973/97

(51) Int. Cl.[7] ..... A63C 17/06

(52) U.S. Cl. ..... 280/11.221; 280/11.224; 36/115; 36/97

(58) Field of Search ..... 280/11.22, 11.3, 280/11.27, 11.26, 11.221, 11.224; 36/115, 97

(56) References Cited

U.S. PATENT DOCUMENTS

| | | | | | |
|---|---|---|---|---|---|
| 1,535,422 | A | * | 4/1925 | Larsen | 280/11.2 |
| 2,572,050 | A | * | 10/1951 | Ornstein | 280/11.3 |
| 3,026,118 | A | * | 3/1962 | Pare | 280/11.3 |
| 4,680,877 | A | | 7/1987 | Fink | |
| D326,700 | S | * | 6/1992 | Brown et al. | 280/11.3 |
| 5,184,834 | A | * | 2/1993 | Yu | 280/7.13 |
| 5,484,149 | A | * | 1/1996 | Lee | 280/11.26 |
| 5,498,009 | A | * | 3/1996 | Young | 280/11.12 |
| 5,549,310 | A | * | 8/1996 | Meibock et al. | 280/11.221 |
| 5,645,288 | A | * | 7/1997 | Lu | 280/11.26 |
| 5,678,833 | A | * | 10/1997 | Olson et al. | 280/11.22 |
| 5,682,687 | A | * | 11/1997 | Arai | 36/97 |
| 5,741,018 | A | * | 4/1998 | Huang | 280/11.3 |
| 5,806,211 | A | * | 9/1998 | Pozzobon | 36/115 |
| 5,836,592 | A | * | 11/1998 | Chang | 280/11.26 |
| 5,839,736 | A | * | 11/1998 | Chiu et al. | 280/11.202 |
| 5,855,383 | A | * | 1/1999 | Harr et al. | 280/11.225 |
| 5,938,213 | A | * | 8/1999 | Gignoux | 280/11.2 |
| 6,113,123 | A | * | 9/2000 | Cabanis et al. | 280/341 |

FOREIGN PATENT DOCUMENTS

| | | |
|---|---|---|
| DE | 28 20 681 | 11/1978 |
| DE | 30 01 380 | 9/1980 |
| DE | 30 43 425 | 7/1982 |
| EP | 0 799 582 | 10/1997 |
| FR | 2 747 049 | 10/1997 |

OTHER PUBLICATIONS

Database WPI Section PQ, Week 8527 Derwent Publications, Ltd., London, GB; Class P22, AN 85–163505 XP002075852 & NL 8 303 889 A (Havekotte J) vori abrégé; figures.

* cited by examiner

*Primary Examiner*—Robert P. Olszewski
*Assistant Examiner*—James S. McClellan
(74) *Attorney, Agent, or Firm*—Bugnion S.A.; John Moetteli

(57) ABSTRACT

An in-line roller skate is described, which consists of a chassis (2) equipped with at least two rollers (3) and which has two platforms (4, 5) and a boot (1) with a flexible upper resting on the platforms and connected to these platforms by a rigid part consisting of a footbed (17) connected to the inside of the flexible upper. The sole is thus securely held between the rigid footbed and at least the rear platform of the chassis.

8 Claims, 10 Drawing Sheets

IN-LINE ROLLER SKATE WITH DETACHABLE BOOT

FIELD OF THE INVENTION

The invention relates to an in-line roller skate consisting of a chassis equipped with at least two rollers and having two platforms and with a boot with a flexible upper resting on the platforms and connected to the chassis by a rigid part.

PRIOR ART

U.S. Pat. No. 5,437,466 discloses an in-line roller skate the boot of which consists of a flexible upper bonded to a rigid base, itself welded to the chassis or forming an integral part of this chassis. Such a construction does not allow the boot to be detached from the chassis, for example to replace the boot by a boot of a different size.

U.S. Pat. No. 5,331,752 and U.S. Pat. No. CA 2,101,718 disclose roller skates with releasable boots, consisting of a chassis formed integrally with means of supporting the boot and of a boot with a flexible sole and upper allowing walking. The support means are in the form of a rigid cradle to which a cuff intended to surround the upper part of the boot upper is hinged. As the practice of roller skating is essentially a summer sport, the front part of the cradle, which surrounds and covers the front of the foot, is perforated to allow air to the foot, but in spite of this the ventilation is often insufficient. What is more, while it is true that the flexible boot is pressed against the bottom and sides of the cradle, it can however move and deform in the cradle, which means that the connection between foot and skaters is not as good as it is in a fixed-boot skate.

Published Patent Appliecation DE 30 43 425 discloses a skate in which the flexible upper of the boot is held between a rigid inner sole and a rigid outer piece the assembly being fixed non-releasably to two platforms of the chassis by studs from the inner sole passing through the rigid outer piece and the platforms to which they are fixed by crushing.

SUMMARY OF THE INVENTION

The object of the invention is to obtain a roller skate in which the boot, fixed or releasable, has a flexible upper, is well ventilated, and can be fixed to a chassis in a readily detachable or releasable way, particularly to a standard chassis, and in which the connection to the chassis is provided by a rigid part which provides a good interface between the leg and the chassis, with practically no play.

To this end, the roller skate according to the invention is one wherein the rigid part of the boot consists exclusively of a footbed or inside connected to the inside of the flexible upper and extending at least from the heel to about the middle of the sole.

According to an embodiment with a non-releasable but detachable boot, the rigid insole extends from the heel to the front end of the boot and is fixed to the platforms of the chassis by screws resting on the insole. In order to detach the boot from the chassis all that is therefore required is for the comfort sole covering the insole to be removed and the screws unscrewed. It is thus easily possible to replace the boot with a boot of a different size or to replace a damaged boot such a boot can be used with a standard chassis like those available commercially.

According to another embodiment, the insole of two rigid parts which overlap each other between the points at which the insole is fixed to the platforms so as to be longitudinally moveable one with respect to the other and at least one of the platforms and/or one of the parts of the insole is designed in such a way as to allow the insole to be attached with said parts in different relative positions. The boot can thus be adapted to the length of the foot, particularly in the case of skates for children and youths.

The skate will generally be equipped with a heel reinforcement at the rear, to which a bottom of-cuff is hinged. However, there is no rigid part covering the front of the boot, which means that this front part, which tends to perspire, remains well ventilated.

According to a releasable-boot embodiment, the rigid insole extends from the heel to about the middle of the sole and has attachment means for releasably fixing it to the chassis, the latter being equipped with corresponding releasable means of attachment.

According to one embodiment of this releasable-boot skate, the attachment means consist, at the front, of a hook secured to the chassis and engaging longitudinally in or over the rigid footbed and, at the rear, of a pawl secured to the chassis and of a toothed part at the rear of the rigid insole, in which toothed part said pawl engages.

BRIEF DESCRIPTION OF THE DRAWINGS

The appended drawing depicts, by way of example, three embodiments of the invention.

DESCRIPTION OF THE PREFERRED EMBODIMENT

Figure 1:
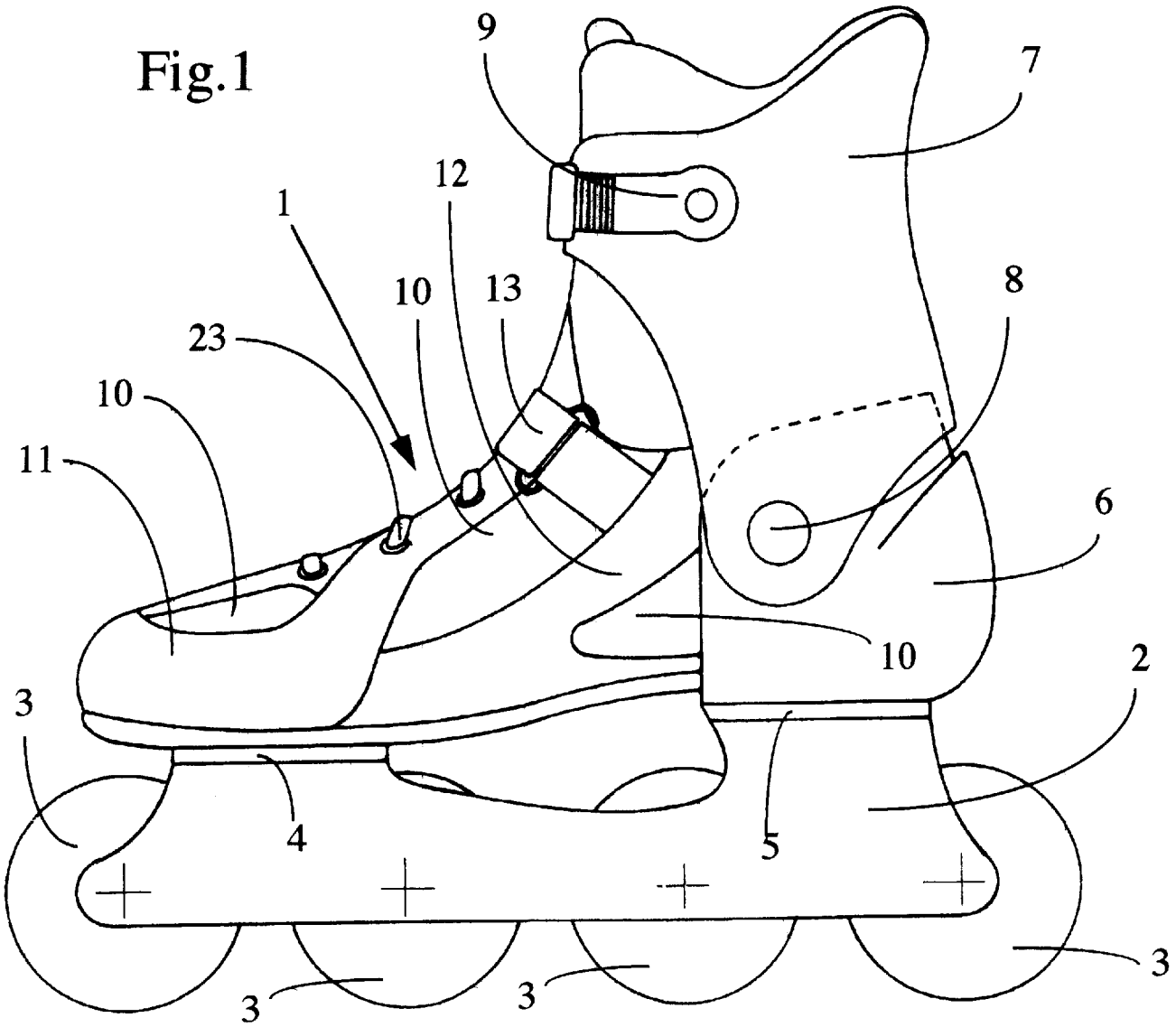
FIG. 1 depicts a first embodiment with a non-releasable boot.
Figure 2:
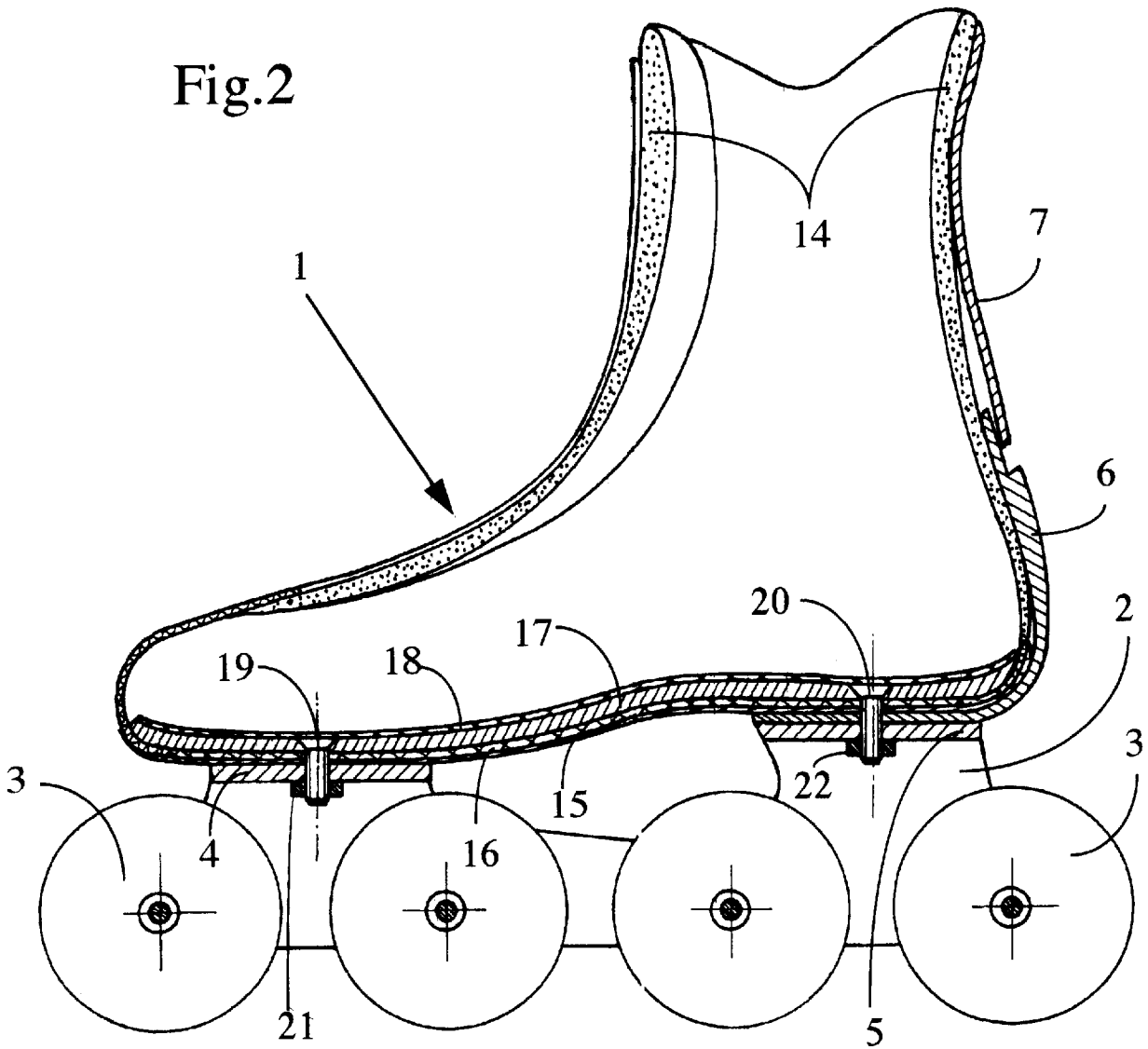
FIG. 2 is a view in vertical axial section through the boot depicted in FIG. 1.

The skate depicted in FIGS. 1 and 2 consists of a boot 1, a rigid insole 17, and of a chassis 2 equipped with four in-line rollers 3 and having a front platform 4 and a rear platform 5 to which the boot 1 is fixed. Also fixed to the rear platform 5 is a heel reinforcement 6 made of rigid plastic forming a shell surrounding the rear part of the boot. A bottom-of-leg cuff 7 is hinged in a known way at two opposed points 8 to the heel reinforcement 6 by rivets. This cuff 7 is equipped with a tightening and fastening device 9.

The boot is made up of a boot subassembly, a closing system and optionally, a comfort sole 18. The closing system is known and includes laces 23 and an instep strap 13. The boot subassembly is made up of an upper and a lower panel or sole, made up of a rubber sole 15 and flexible insole 16, connected together by known means. The upper of the boot 1 essentially is made up of a woven structure 10 providing the foot with good ventilation and of reinforced parts such as 11 and 12. As can be seen in FIG. 2, the boot upper also may have foam 14 inside for comfort.

The sole of the boot 1 consists of a rubber sole 15 and of a flexible insole 16. Connected inside the upper is the rigid insole 17, preferably made of rigid plastic, on which a comfort sole 18 is disposed. The boot 1 is fixed to the chassis 2 by means of screws 19 and 20 screwed respectively into the platforms 4 and 5 of the chassis and the heads of which rest on the rigid insole 17 so as to sandwich the boot subassembly against the chassis. In the embodiment depicted, the screws 19 and 20 are also fitted with lock nuts 21 and 22. There could of course be more than two screws. The heel reinforcement 6 is also fixed to the rear platform 5 by the screw 20. It is therefore not necessary for this heel reinforcement 6 to be fixed either to the platform 5 or to the boot by any other means such as bonding.

In an alternative form, the heel reinforcement is formed integrally with the rear platform 5.

The insole 17 provides an excellent interface between foot and chassis. Furthermore, the foot can press firmly, without play, against the insole thanks to the flexibility of the upper, the lacing 23 and the strap 13.

If the boot needs to be replaced, all that is required is for the comfort sole 18 to be lifted in order to gain access to the screws 19 and 20 and unscrew these screws.

Figure 3:
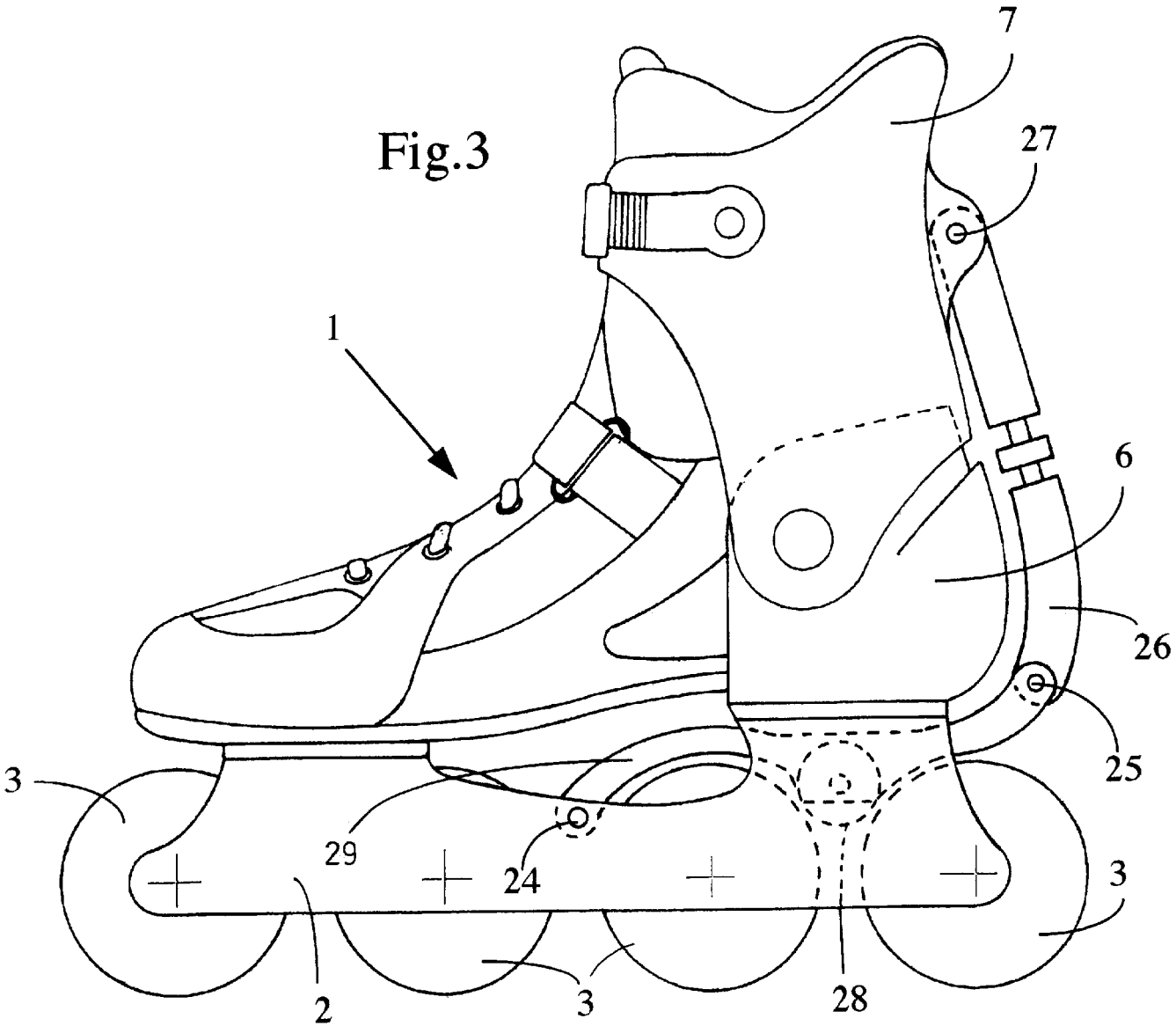
FIG. 3 depicts an alternative form, equipped with a brake, of the first embodiment.

FIG. 3 depicts an alternative form of the embodiment depicted in FIG. 1 and 2. In this alternative form, the skate is equipped with a brake operated by the cuff 7. This brake comprise an arm 29 in the shape of a very extended S hinged by one of its ends at a point 24 of the chassis that lies between the two middle rollers, and by its other end, about an axis 25, to the end of an arm 26 articulated at its upper end about an axis 27 at the rear of the cuff 7. The arm 29 is equipped with a roller 28 which brakes against the two rear rollers when the cuff 7 is tilted backward. Such a brake is described in Patent Application FR 97 00799.

The embodiment witch a releasable boot will now be described with reference to FIGS. 4 and 5.

Figure 4:
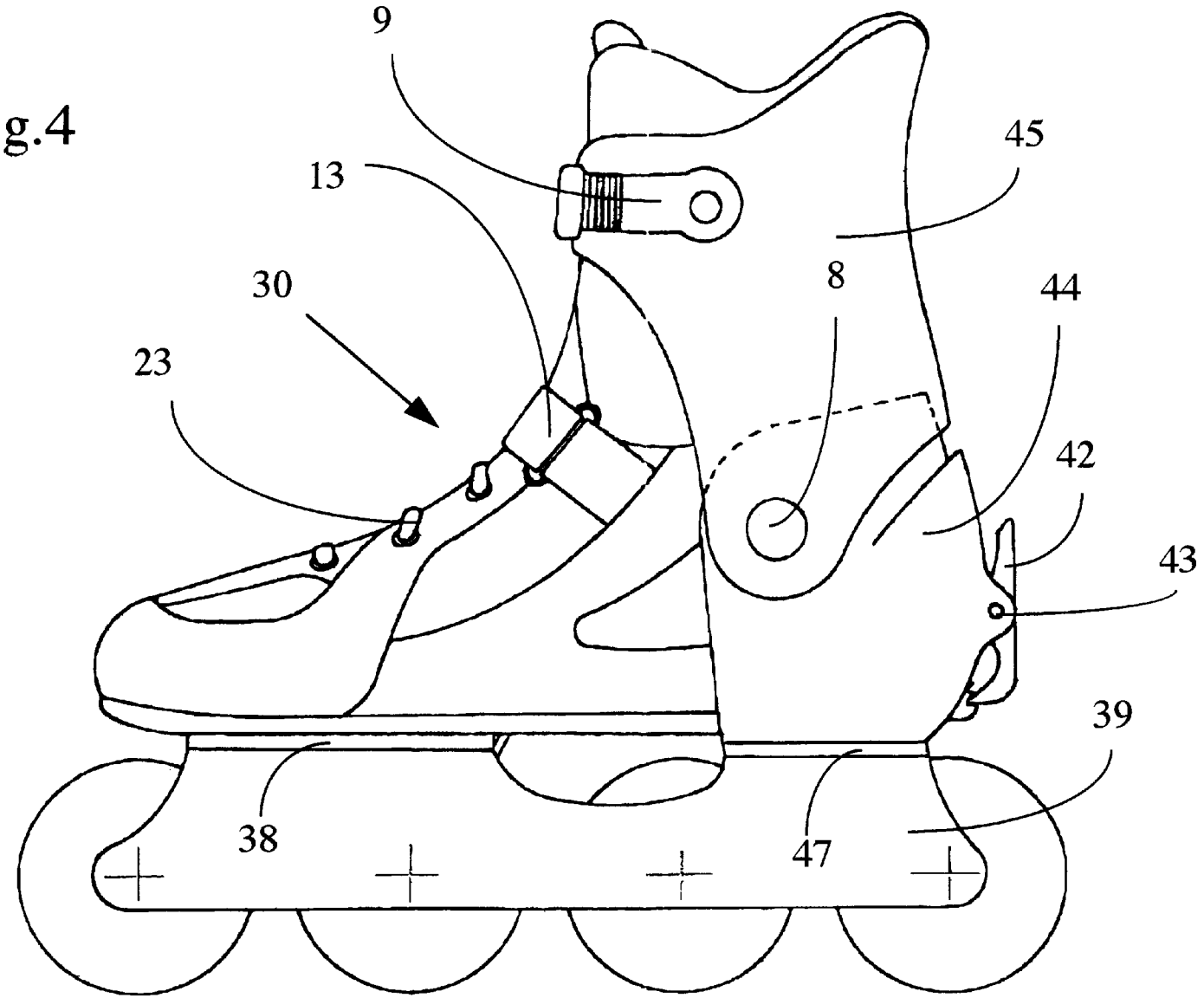
FIG. 4 depicts a second embodiment, with a releasable boot.
Figure 5:
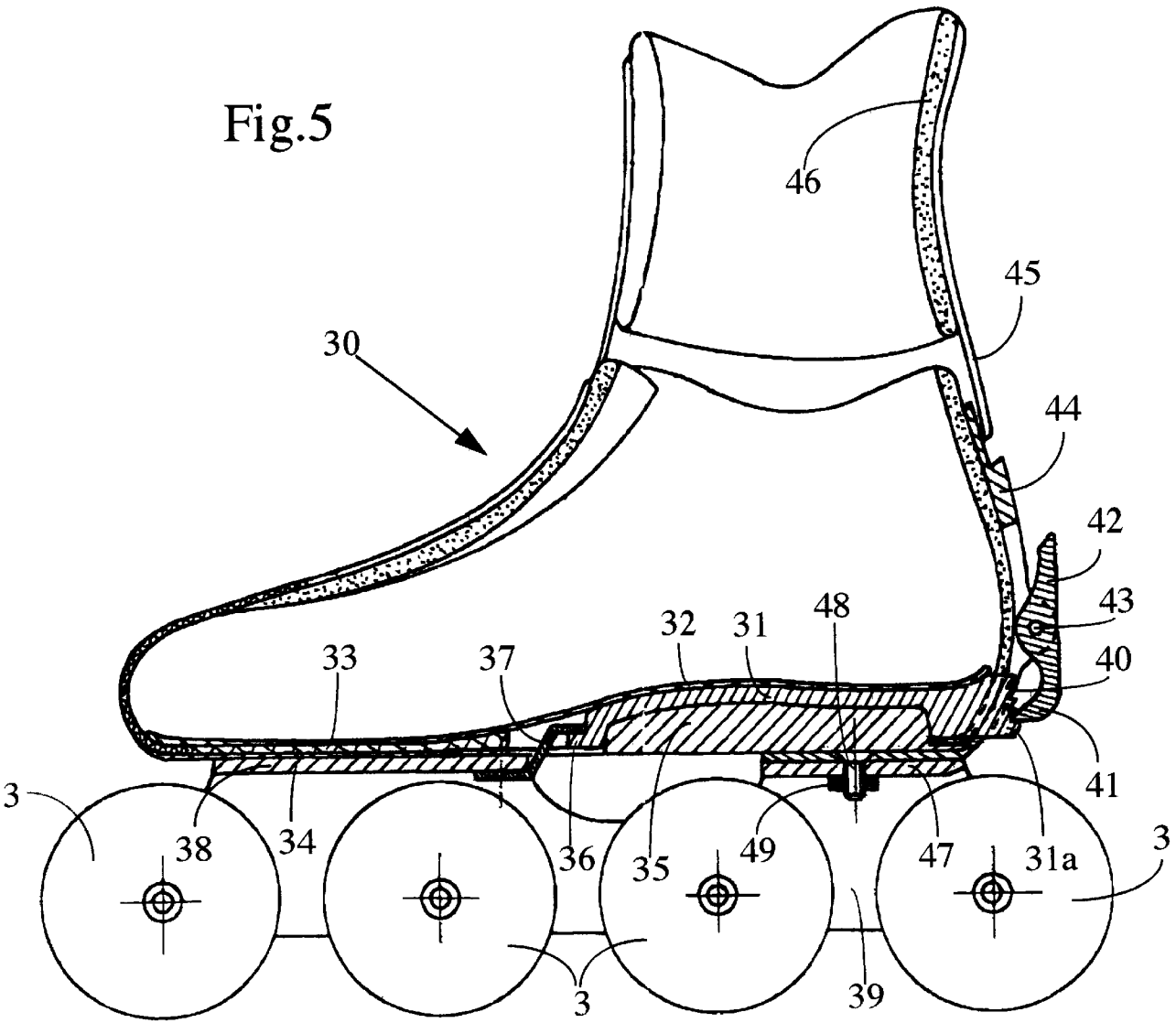
FIG. 5 is a view in vertical axial section through the second embodiment.

In this embodiment, the boot 30 has a short upper, the structure of this upper being similar to that of the upper of the boot 1 of the first embodiment, as is clear, in FIG. 4. The boot 30 is equipped with a rigid footbed 31, again preferably made of plastic, with a longitudinal profile in the form of an upturned and curved dish extending from the heel to approximately the middle of the sole and covered with a comfort inner sole 32. From the middle of the boot forward, the sole consists of a flexible insole 33, and of a rubber sole 34. Under the foot-bed 31, the sole consists of relatively thick rubber 35. The boot 30 is therefore flexible forward of the rigid insole 31, which allows for easy walking.

The front end of the insole 31 has a projection 36 interacting with an attachment member 37 secured to the front platform 38 of the chassis 39 of the skate. The rear end 31*a* of the insole 31 projects out of the boot and has ratchet-teeth toothing 40 interacting with the nose 41 of a pawl 42 hinged about an axis 43 on a heel reinforcement 44 similar to the reinforcement 6 in FIG. 1 and, like it, bearing a cuff 45 hinged to the reinforcement 44 in the region of the ankle bone and also equipped with a tightening and fastening device similar to the device 9 of FIG. 1. Unlike the first embodiment, the cuffs 45 has comfort foam 46 on its internal wall because, in this case, the cuff 45 replaces the top part of the boot upper. The heel reinforcement 44 is fixed to the rear platform 47 of the chassis by means of at least one screw 48 locked by a nut 49.

To secure the boot 30 to the chassis 39 all that required is for the bearing surface 36 of the insole to be engaged under the attachment member 37 of the chassis, then for the heel of the boot to be pressed onto the rear platform 47. During this pressing action, the nose of the pawl 41 is pushed away by the rounded lower edge of the part 31*a* and engages in the toothing 40.

When the boot is new, the nose of the pawl 41 engages under the first tooth of the toothing 40. Once the sole has worn down a certain amount, the nose of the pawl engages under the next tooth, and so on. The toothing 40 thus allows the boot to be still held securely despite the wear of the sole 35.

The skate with releasable boot depicted in FIG. 4 may of course also be equipped with a brake similar to the brake depicted in FIG. 3, that is to say operated by the cuff 45.

Figure 6:
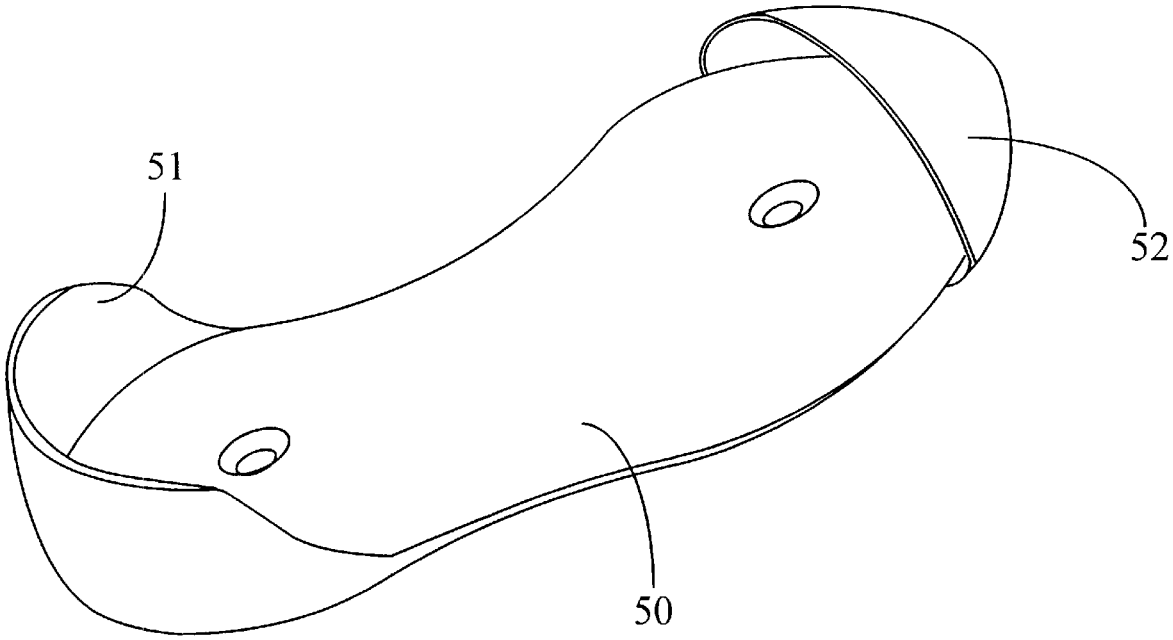
FIG. 6 depicts an alternative form of the insole of the first embodiment.

FIG. 6 depicts, by way of an alternative form of the insole 17 of the first embodiment, a rigid insole 50 equipped with a heel reinforcement 51 and a hard end 52 to protect the toes. Such a insole may be equipped with its own comfort means.

The insole for a non-releasable boot does not necessarily need to cover the entire sole, but may be narrowed in its central region and/or have a number of cut-outs.

A third embodiment will now be described with reference to FIGS. 7 to 10.

With a view to avoiding needless repetition, the elements which are taken again from the first embodiment have been denoted by the same reference numerals.

Figure 7:
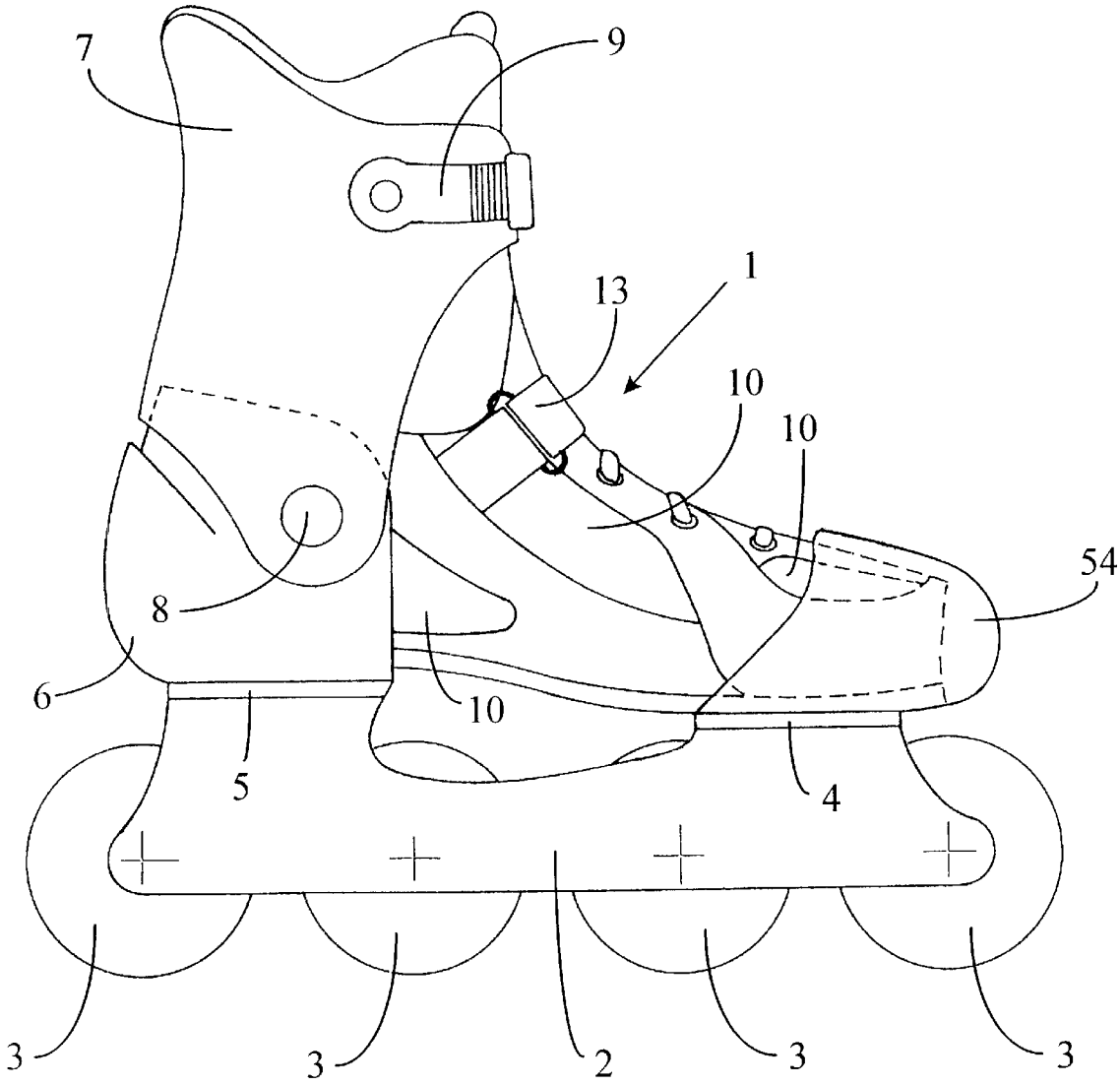
FIG. 7 depicts a third embodiment with an adjustable size.

Externally, the skate depicted in FIG. 7 differs from the skate depicted in FIG. 1 only in the presence, at the front, of a cap 54 fixed to the front platform 4 and enveloping the end of the foot.

Figure 8:
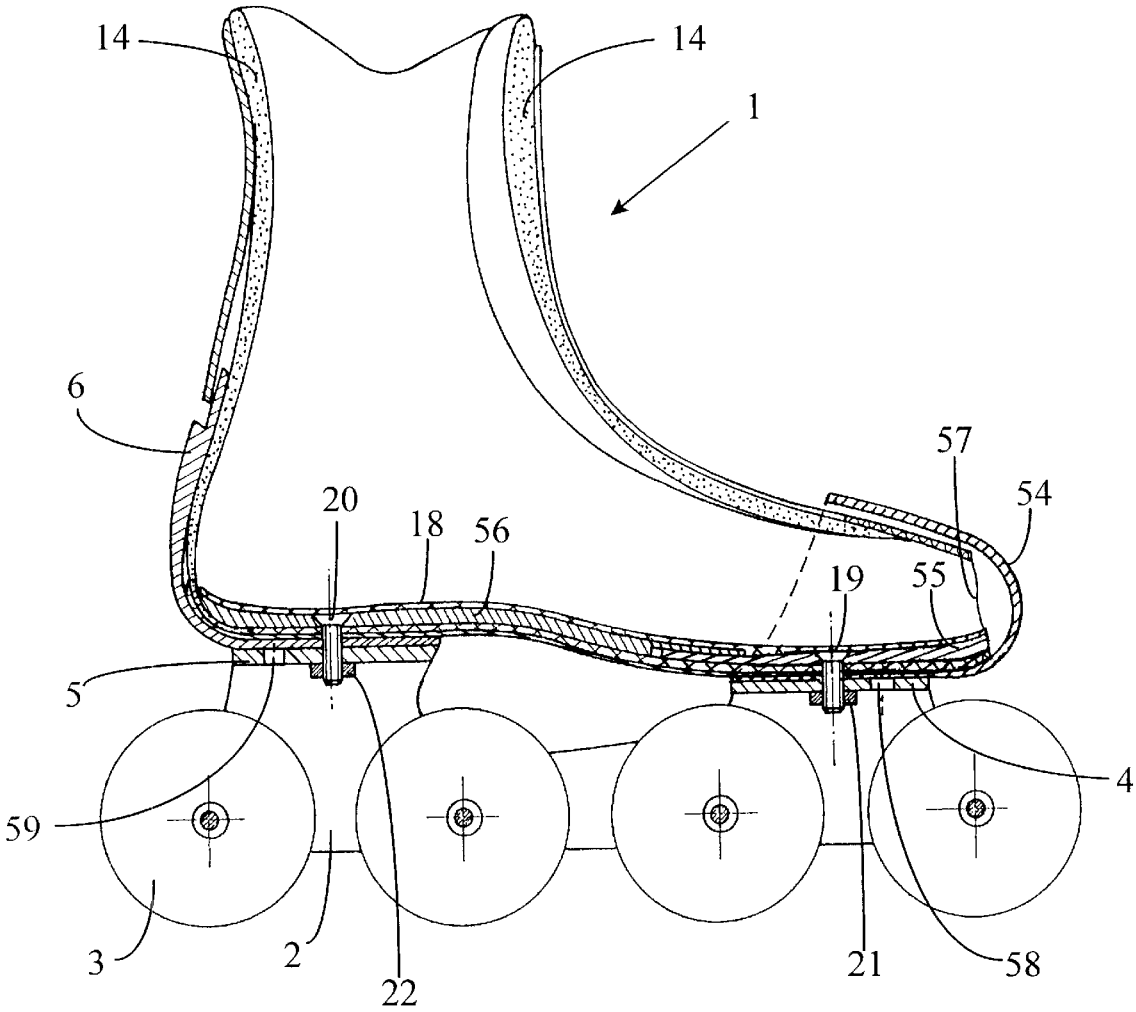
FIG. 8 is a view in longitudinal section through the skate depicted in FIG. 7.

By contrast, on the inside, as can be seen in FIG. 8, the boot of this third embodiment differs from the first embodiment in that, on the one hand, the rigid insole is made up of two parts 55 and 56 which overlap one another between the points at which the insole is fixed to the platforms 4 and 5 and, on the other hand, in that the front end 57 of the boot upper is open, the boot here being closed by the cap 54. The front platform 4 has at least one second hole 58 situated forward of the hole through which the fixing screw 20 passes on the axis of symmetry of the skate, and the rear platform 5 also has at least one second hole 59 located to the rear of the hole through which the fixing screw 19 passes. Like the holes used in FIG. 8, the holes 58 and 59 have a diameter which just allows the screws 19 and 20 to pass. These holes could also be tapped so that the screws 19 and 20 screw only into the nuts 21 and 22 but also into the platforms themselves.

Figure 9:
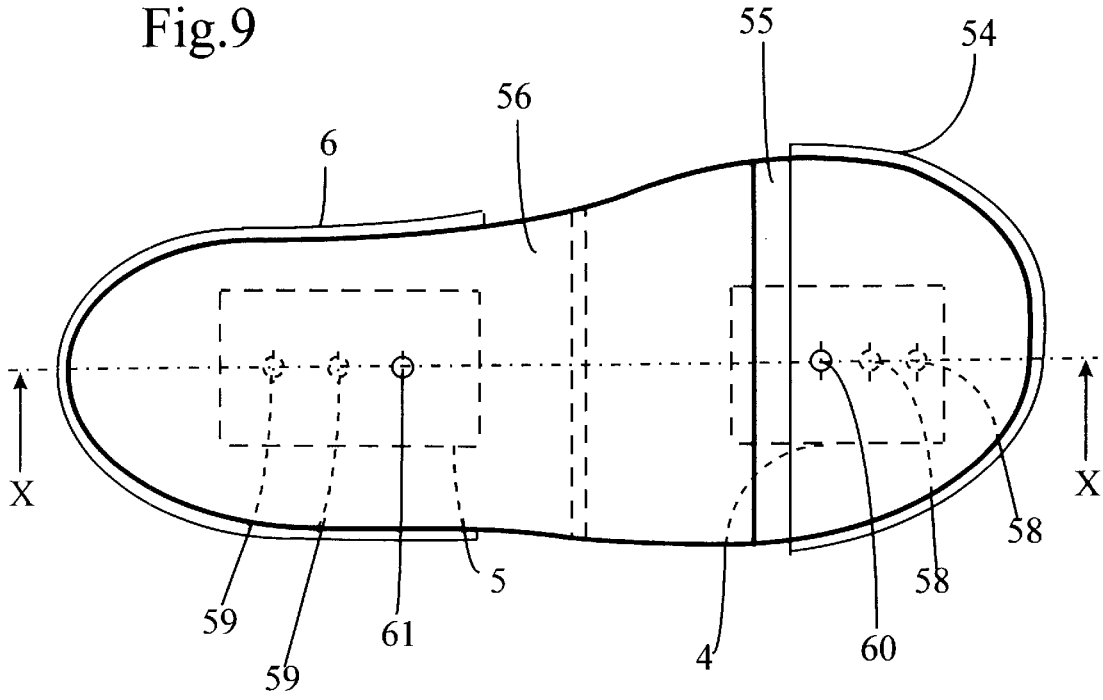
FIG. 9 is a plan view, from above, of the footbed of this third embodiment.
Figure 10:
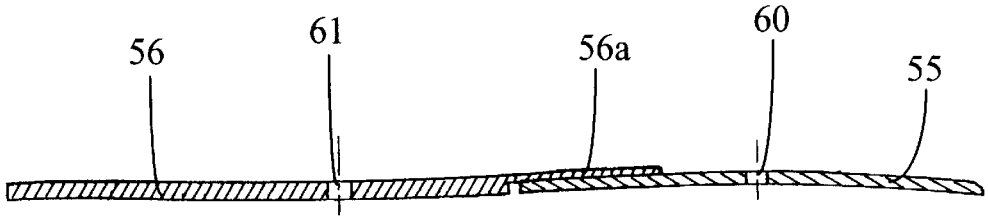
FIG. 10 is a view in section on X—X of FIG. 9.

The overlap of the two parts 55 and 56 of the rigid footbed can be seen more clearly in FIGS. 9 and 10. The part 56 has a thinned portion 56a extending over the part 55 a little thinner than the part 56 so that the lower faces of the two parts 55 and 56 are at the same level. FIGS. 9 and 10 also show the holes 60 and 61 for the passage of the screws 19 and 20, and the additional holes 58 and 59 in the platforms 4 and 5. The front cap 54 is depicted in fine line.

In this third embodiment, it is thus possible to lengthen the footbed by fixing one of the parts 55 or 56 or both of these two parts in a different hole 58 and 59 of the platforms. This then makes it possible to lengthen the boot which can thus grow with the child's foot. The front cap 54 moves with the screw 19. The cap 54 can be lined with a foam for greater comfort.

Figure 11:
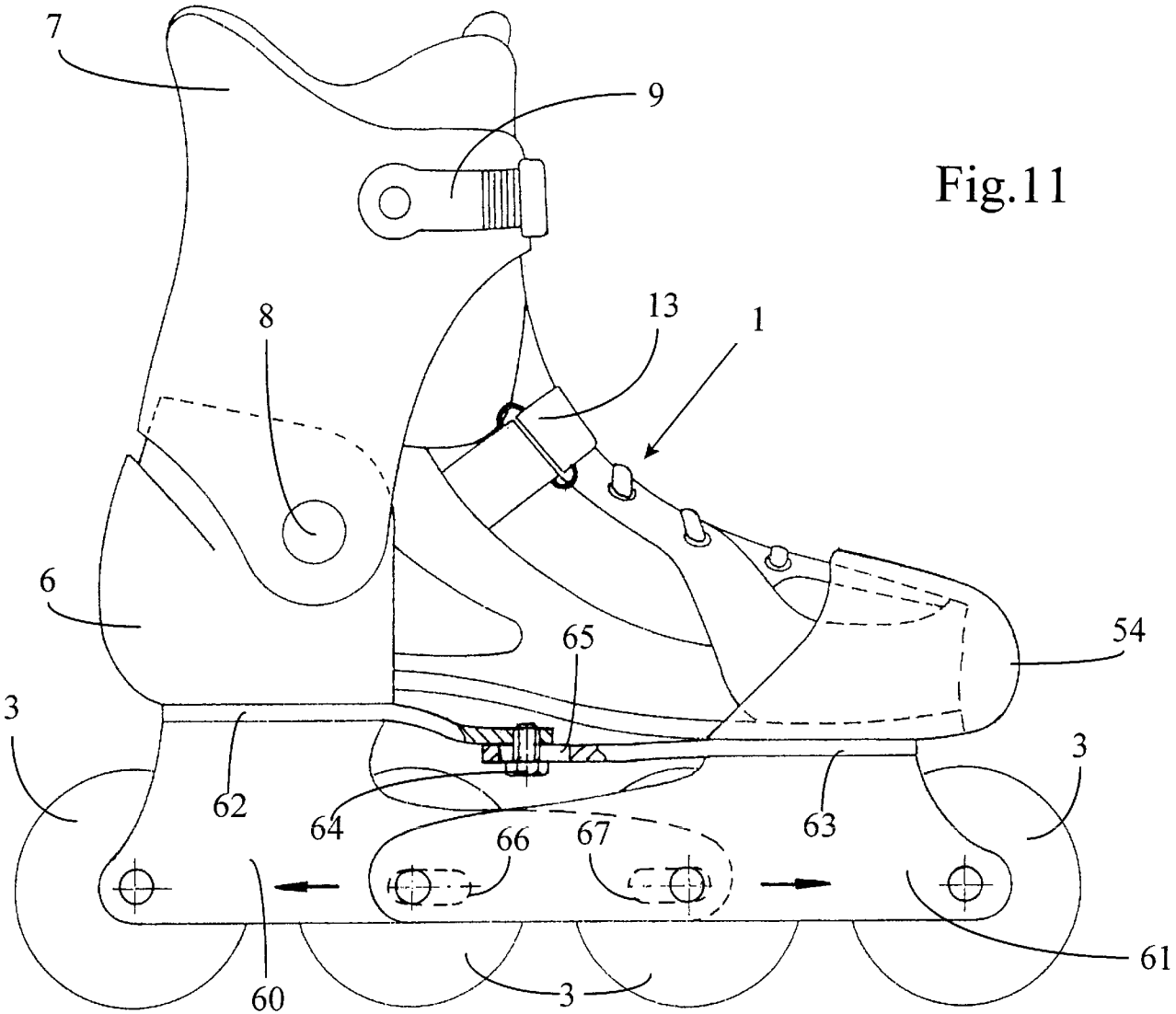
FIG. 11 depicts an alternative form of the third embodiment.

According to an alternative form of this last embodiment, depicted in FIG. 11, the points at which the insole is fixed to the platforms of the chassis are unique and therefore remain unchanged as the insole is lengthened or shortened. The chassis, on the other hand, is made in two parts 60 and 61, the platforms 62 and 63 of which are joined together by extensions fixed together by a screw 64 passing through a slot 65 in the lower extension to allow the two parts of the chassis to move relative to one another. Likewise, the wings of the chassis overlap under the central region of the boot and the axles of the two central rollers, borne by one of the parts of the chassis, pass through the other part through two slots 66 and 67 respectively. The wings of the chassis may also be fixed together by one or two screws in addition to the screw 65 or in place of this screw. The screw 64 could also be used for fixing the two parts 55 and 56 of the insole together.

This alternative form has the advantage that the chassis grows with the boot and that the heel always rests over the two rear rollers at the same point.

What is claimed is:

1. An in-line roller skate comprising (a) a chassis (2; 39) equipped with at least two rollers (3) and having two platforms (4, 5; 34, 47);

(b) a boot subassembly comprising a supple upper and a lower panel which are connected together so as to be able to enclose a wearer's foot, the supple upper accomodating a closing system (23, 13);

(c) a rigid part separable from the boot subassembly without causing the disassembly of the supple upper from the lower panel of the boot subassembly;

wherein the boot subassembly is held in place by sandwiching of its lower panel between the platforms and the rigid part by fasteners that bear on and between the rigid part and the chassis so as to facilitate removal of the rigid part and thus disassembly of the chassis from the boot, the rigid part comprising a rigid insole (17; 31; 50; 55, 56) which extends at least from the heel to about the middle of the panel, wherein the insole comprises two flat, rigid parts (55, 56) which overlap each other between the platforms (4, 5) and which are longitudinally moveable one with respect to the other and wherein at least one of the platforms or one of the parts of the insole allows the insole to be fixed with the platforms in different relative positions.

2. The skate as claimed in claim 1, wherein the upper of the boot is open at its front end and wherein this end is covered by a cap (54) fixed to the front platform with the insole.

3. An in-line roller skate comprising (a) a chassis (2; 39) equipped with at least two rollers (3) and having two platforms (4, 5; 34, 47);

(b) a boot subassembly comprising a supple upper and a lower panel which are connected together so as to be able to enclose a wearer's foot, the supple upper accomodating a closing system (23, 13);

(c) a rigid part separable from the boot subassembly without causing the disassembly of the supple upper from the lower panel of the boot subassembly;

wherein the boot subassembly is held in place by sandwiching of its lower panel between the platforms and the rigid part by fasteners that bear on and between the rigid part and the chassis so as to facilitate removal of the rigid part and thus disassembly of the chassis from the boot, the rigid part comprising a rigid insole (17; 31; 50; 55, 56) which extends at least from the heel to about the middle of the panel, wherein the insole comprises two parts (55, 56) which overlap each other between the points at which they are fixed to the platforms (62, 63) so as to be longitudinally moveable one with respect to the other and wherein the chassis is in two parts (61, 62) which overlap each other so as also to be longitudinally moveable one with respect to the other, means (65) being provided for fixing the two parts of the chassis together in the desired position.

4. The skate as claimed in claim 3, wherein the upper of the boot is open at its front end and wherein this end is covered by a cap (54) fixed to the front platform with the insole.

5. An in-line roller skate comprising (a) a chassis (2; 39) equipped with at least two rollers (3) and having two platforms (4, 5; 34, 47);

(b) a boot subassembly comprising a supple upper and a lower panel which are connected together so as to be able to enclose a wearer's foot, the supple upper accomodating a closing system (23, 13);

(c) a rigid part separable from the boot subassembly without causing the disassembly of the supple upper from the lower panel of the boot subassembly;

wherein the boot subassembly is held in place by sandwiching of its lower panel between the platforms and the rigid part by fasteners that bear on and between the rigid part and the chassis so as to facilitate removal of the rigid part and thus disassembly of the chassis from the boot, the rigid part comprising a rigid insole (17; 31; 50; 55, 56) which extends at least from the heel to about the middle of the panel, in which the insole (31) extends from the heel to about the middle of the sole, which has attachment means (36, 40) for releasably fixing it to the chassis, and wherein the chassis is equipped with corresponding releasable means (37, 42) of attachment, wherein the attachment means comprise, at the front, of a hook (37) secured to the chassis and engaging longitudinally in or over the insole (31) and, at the rear, of a pawl (42) secured to the chassis and of a toothed part (40) at the rear of the insole, in which toothed part said pawl engages.

6. An in-line roller skate comprising (a) a chassis (2; 39) equipped with at least two rollers (3) and having two platforms (4, 5; 34, 47);

(b) a boot subassembly comprising a supple upper and a lower panel which are connected together so as to be able to enclose a wearer's foot, the supple upper accomodating a closing system (23, 13);

(c) a rigid part separable from the boot subassembly without causing the disassembly of the supple upper from the lower panel of the boot subassembly;

wherein the boot subassembly is held in place by sandwiching of its lower panel between the platforms and the rigid part by fasteners that bear on and between the rigid part and the chassis so as to facilitate removal of the rigid part and thus disassembly of the chassis from the boot, the rigid part comprising a rigid insole (17; 31; 50; 55, 56) which extends at least from the heel to about the middle of the panel, wherein the insole (50) is equipped with a heel reinforcement (51).

7. The skate as claimed in claim 6, wherein the insole has a hard end (52).

8. An in-line roller skate comprising (a) a chassis (2; 39) equipped with at least two rollers (3) and having two platforms (4, 5; 34, 47);

(b) a boot subassembly comprising a supple upper and a lower panel which are connected together so as to be able to enclose a wearer's foot, the supple upper accomodating a closing system (23, 13);

(c) a rigid part separable from the boot subassembly without causing the disassembly of the supple upper from the lower panel of the boot subassembly;

wherein the boot subassembly is held in place by sandwiching of its lower panel between the platforms and the rigid part by fasteners that bear on and between the rigid part and the chassis so as to facilitate removal of the rigid part and thus disassembly of the chassis from the boot, the rigid part comprising a rigid insole (17; 31; 50; 55, 56) which extends at least from the heel to about the middle of the panel, wherein the insole is equipped with its own comfort means.

* * * * *